US006779743B2

(12) United States Patent
Kitamura

(10) Patent No.: US 6,779,743 B2
(45) Date of Patent: Aug. 24, 2004

(54) FUEL INJECTION VALVE

(75) Inventor: Koji Kitamura, Kakuda (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/464,857

(22) Filed: Jun. 19, 2003

(65) Prior Publication Data

US 2004/0050976 A1 Mar. 18, 2004

(30) Foreign Application Priority Data

Jun. 19, 2002 (JP) ..... 2002-178457

(51) Int. Cl.[7] ..... F02M 61/00

(52) U.S. Cl. ..... 239/533.12; 239/533.11; 239/533.2; 239/533.14; 239/585.1; 239/596

(58) Field of Search ..... 239/494, 533.1, 239/533.2, 533.3, 533.11, 533.12, 533.14, 533.15, 585.1, 585.2, 585.3, 585.4, 585.5, 596

(56) References Cited

U.S. PATENT DOCUMENTS 5,862,991 A * 1/1999 Willke et al. ..... 239/585.4
6,405,946 B1 * 6/2002 Harata et al. ..... 239/533.12
6,616,071 B2 * 9/2003 Kitamura et al. ..... 239/533.12
2002/0063174 A1 * 5/2002 Arioka et al. ..... 239/585.1
2003/0141387 A1 * 7/2003 Xu ..... 239/533.12

FOREIGN PATENT DOCUMENTS

JP 2000-97129 4/2000

* cited by examiner

*Primary Examiner*—Robin O. Evans
(74) *Attorney, Agent, or Firm*—Arent Fox PLLC

(57) ABSTRACT

In a fuel injection valve including a flat fuel diffusion chamber provided between a valve seat member and an injector plate to widen radially outwards from an outer end edge of a valve seat bore, an annular step is formed on a ceiling surface of the fuel diffusion chamber so that a level of the ceiling surface is gradually lowered radially outwards, and fuel injection orifices are disposed immediately below the step and at a distance from an inner peripheral wall of the fuel diffusion chamber. Thus, a fuel spread radially in the fuel diffusion chamber is allowed to collide with the annular step, leading to an enhancement in fuel diffusing effect, so that it is possible to further promote the atomization of the fuel injected from the fuel injection orifices and to form more stable fuel spray forms.

4 Claims, 6 Drawing Sheets

FUEL INJECTION VALVE

BACKGROUND OF THE INVENTION

1. Field of the Invention

The present invention relates to a fuel injection valve used mainly in a fuel supply system for an internal combustion engine, and particularly to an improvement in a fuel injection valve comprising: a valve member; a valve seat member which has a valve seat cooperating with said valve member, and a valve seat bore leading to a downstream end of said valve seat and opening at a front end face said valve seat member; an injector plate coupled to the front end face of said valve seat member and having a plurality of fuel injection orifices; and a flat fuel diffusion chamber provided between said valve seat member and said injector plate to widen radially outwards from an outer end edge of said valve seat bore for dispensing a fuel received therein from said valve seat bore to the plurality of fuel injection orifices in a diffusing manner.

2. Description of the Related Art

A conventional fuel injection valve is already known, as disclosed in, for example, Japanese Patent Application Laid-open No. 2000-97129.

The conventional injection valve has the following advantage: During opening of the valve member, a high-pressure fuel passed through the valve seat is allowed to flow at a high speed into the fuel diffusion chamber to be diffused, thereby promoting the atomization of the fuel injected from each of the fuel injection orifices in the injector plate and forming stable fuel spray forms.

SUMMARY OF THE INVENTION

Accordingly, it is an object of the present invention to provide a fuel injection valve, wherein the fuel-diffusing function of the fuel diffusion chamber can be further enhanced, to thereby further promote the atomization of the fuel injected from the fuel injection orifices and to form more stable fuel spray forms.

To achieve the above object, according to a first feature of the present invention, there is provided a fuel injection valve comprising: a valve member; a valve seat member which has a valve seat cooperating with said valve member, and a valve seat bore leading to a downstream end of said valve seat and opening at a front end face said valve seat member; an injector plate coupled to the front end face of said valve seat member and having a plurality of fuel injection orifices; and a flat fuel diffusion chamber provided between said valve seat member and said injector plate to widen radially outwards from an outer end edge of said valve seat bore for dispensing a fuel received therein from said valve seat bore to the plurality of fuel injection orifices in a diffusing manner; wherein an annular step is formed on a ceiling surface of said fuel diffusion chamber so that a level of the ceiling surface is gradually lowered radially outwards, and said fuel injection orifices are disposed immediately below said step and at a distance from an inner peripheral wall of said fuel diffusion chamber.

With the first feature, during opening of the valve member, the fuel transferred from the valve seat bore into the flat fuel diffusion chamber flows to spread radially. Thereafter, the fuel flowing along the ceiling surface of the fuel diffusion chamber collides with the annular step to be scattered to the periphery, and the flow flowing along a bottom surface of the fuel diffusion chamber collides with the inner peripheral wall of the chamber to be scattered while being bounced back therefrom. The scattered fuel portions again collide with one another immediately above the plurality of fuel injection orifices, whereby the fierce turbulent flow and diffusion of the fuel are caused. As a result, the atomization of the fuel injected from the fuel injection orifices can be effectively promoted, and stable fuel spray forms can be formed and drawn into the engine along with intake air, while being prevented from being deposited to an inner wall of an intake passage for the engine to the utmost. Thus, it is possible to provide enhancements in startability and output performance of the engine as well as a reduction in fuel consumption.

According to a second feature of the present invention, in addition to the first feature, a diameter of a pitch circle of the plurality of fuel injection orifices is equal to a diameter of the annular step.

With the second feature, the fuel turbulent flow generated in the fuel diffusion chamber can be injected with a good efficiently from the fuel injection orifices, thereby effectively promoting the atomization of the fuel.

According to a third feature of the present invention, in addition to the first or second feature, the valve seat bore is formed into a funnel-shape having a diameter increasing toward the fuel diffusion chamber.

With the third feature, the flowing of the fuel from the valve seat bore into the fuel diffusion chamber can be smoothened, whereby a high speed of collision of the fuel with the annular step can be maintained, and the atomization of the fuel injected from the fuel injection orifices can be promoted.

According to a fourth feature of the present invention, in addition to the first or second feature, a plurality of the annular steps having different diameters are formed in a stair-shape on the ceiling surface of the fuel diffusion chamber, and a plurality of the fuel injection orifices are disposed on each of a plurality of pitch circles having different diameters in correspondence to the annular steps, respectively.

With the fourth feature, the fuel transferred from the valve seat bore into the fuel diffusion chamber collides sequentially with the stair-shaped annular steps and the inner peripheral wall of the fuel diffusion chamber, whereby more fierce turbulent flow and diffusion of the fuel are caused, so that the atomization of the fuel injected from the fuel injection orifices can be further effectively promoted.

The above and other objects, features and advantages of the invention will become apparent from the following description of the preferred embodiments taken in conjunction with the accompanying drawings.

DESCRIPTION OF THE PREFERRED EMBODIMENTS

A first embodiment of the present invention will first be described with reference to FIGS. 1 to 4.

Figure 1:
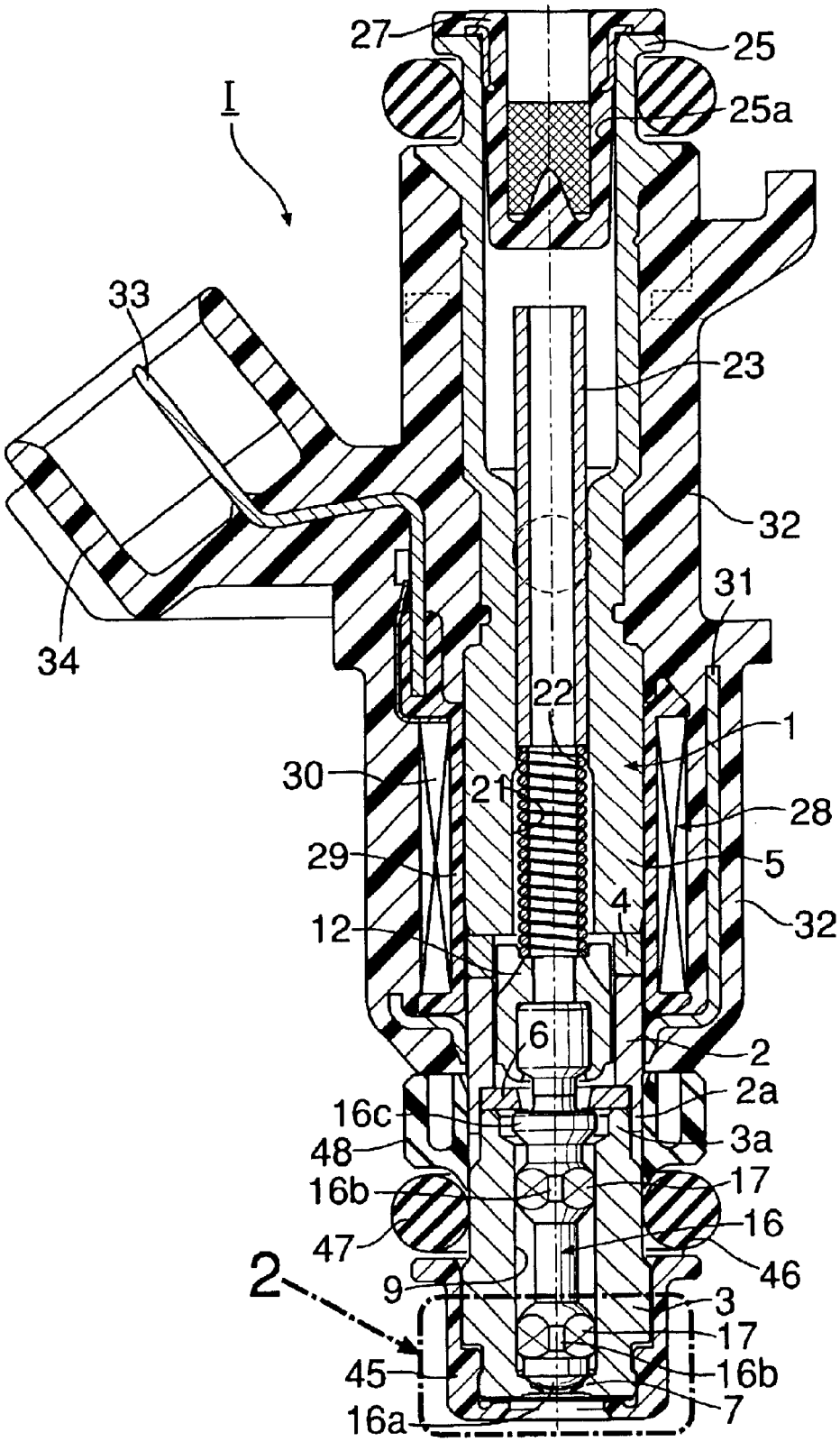
FIG. 1 is a vertical sectional view of a solenoid-type fuel injection valve for an internal combustion engine according to a first embodiment of the present invention.

Referring to FIG. 1, a casing 1 of a solenoid-type electromagnetic fuel injection valve I for an internal combustion engine is comprised of a cylindrical valve housing 2 (made of a magnetic material), a bottomed cylindrical valve seat member 3 liquid-tightly coupled to a front end of the valve housing 2, and a cylindrical core 5 liquid-tightly coupled to a rear end of the valve housing 2 with an annular spacer 4 interposed therebetween.

The annular spacer 4 is made of a non-magnetic metal such as stainless steel, and the valve housing 2 and the stationary core 5 are butted against and liquid-tightly welded to opposite end faces of the annular spacer 4 over the entire periphery.

A first fitting tube 3*a* and a second fitting tube 2*a* are formed on opposed end faces of the valve seat member 3 and the valve housing 2, respectively. The first fitting tube 3*a* is press-fitted into the second fitting tube 2*a* along with a stopper plate 6, which is clamped between the valve housing 2 and the valve seat member 3. Thereafter, the valve housing 2 and the valve seat member 3 are liquid-tightly coupled to each other by a laser welding or beam welding carried out over the entire periphery of a corner sandwiched between an outer periphery surface of the first fitting tube 3*a* and an end face of the second fitting tube 2*a*.

The valve seat member 3 is provided at its front end face with a conical valve seat 7 which opens at its downstream end, and a cylindrical guide bore 9 connected to an upstream end, i.e., a larger-diameter portion of the valve seat 7. The guide bore 9 is formed coaxially with the second fitting tube 2*a*.

A movable core 12 is slidably received in the valve housing 2 and the annular space 4 and opposed to a front end of the stationary core 5. A valve member 16 axially slidably received in the guide bore 9 is integrally coupled to the movable core 12. The valve member 16 is integrally provided with a spherical valve portion 16*a* capable of being seated on the valve seat 7, a pair of front and rear journal portions 16*b*, 16*b* slidably carried in the guide bore 9, and a flange 16*c* adapted to abut against the stopper plate 6 to define an opening limit for the valve member 16. A plurality of chamfers 17 are provided on each of the journal portions 16*b* to enable the flowing of a fuel.

The stationary core 5 has a hollow 21 communicating with the interior of the valve housing 2. The hollow 21 accommodates a coil-shaped valve spring 22 for biasing the movable core 12 in a direction to close the valve member 16, i.e., toward a direction to seat on the valve seat 7, and a pipe-shaped retainer 23 for supporting a rear end of the valve spring 22.

An inlet tube 25 is integrally connected to a rear end of the stationary core 5, and has a fuel inlet 25*a* communicating with the hollow 21 in the stationary core 5 through the pipe-shaped retainer 23. A fuel filter 27 is mounted in the fuel inlet 25*a*.

A coil assembly 28 is fitted over outer peripheries of the annular spacer 4 and the stationary core 5. The coil assembly 28 comprises a bobbin 29 fitted over the outer peripheries of the annular spacer 4 and the stationary core 5, and a coil 30 wound around the bobbin 29. One end of a coil housing 31 surrounding the coil assembly 28 is coupled by welding to an outer peripheral surface of the valve housing 2.

The coil housing 31, the coil assembly 28 and the stationary core 5 are embedded in a cover 32 made of a synthetic resin. A coupler 34 is integrally connected to an intermediate portion of the cover 32, and accommodates a connecting terminal 33 leading to the coil 30.

Figure 2:
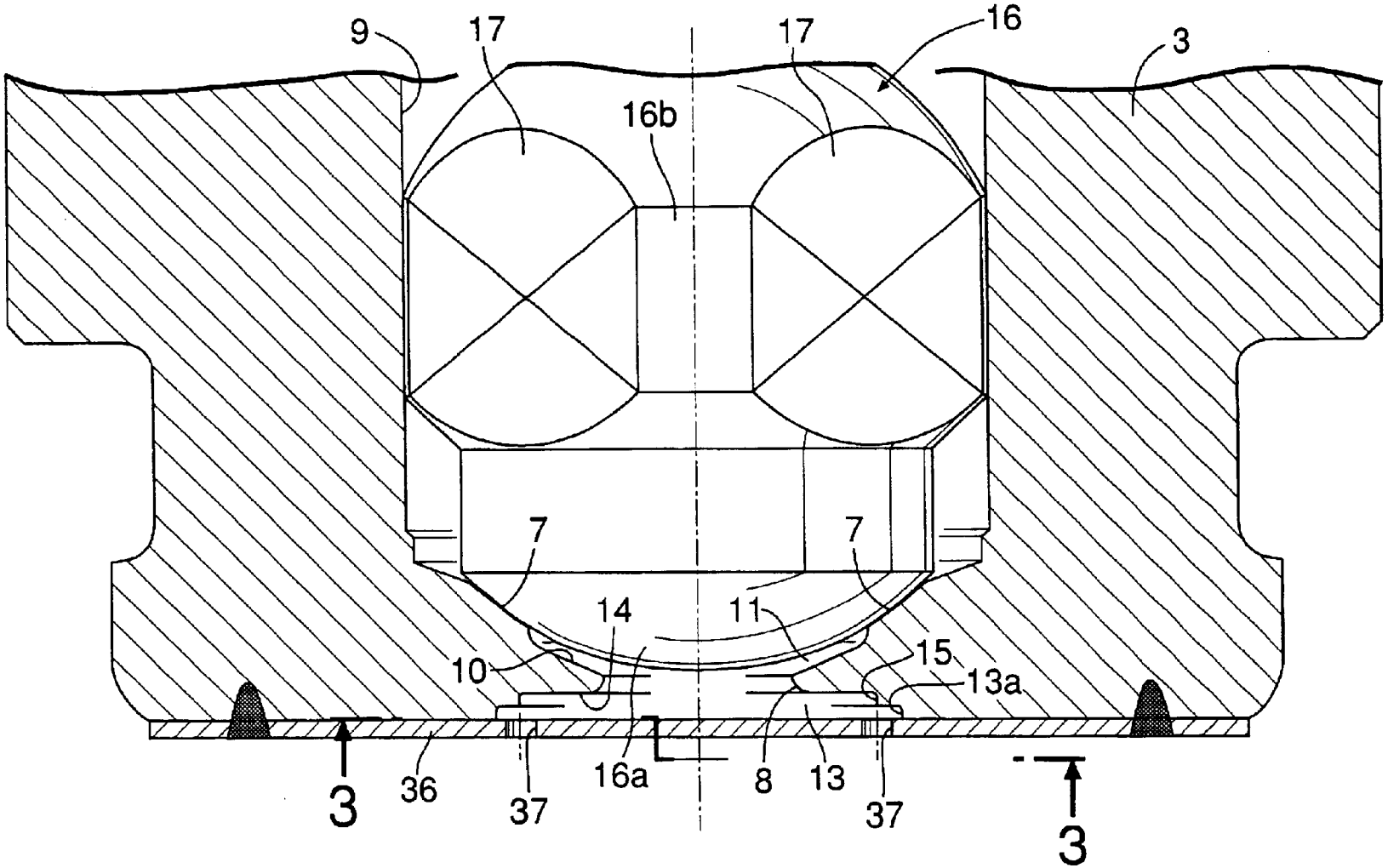
FIG. 2 is an enlarged view of a portion indicated by 2 in FIG. 1.
Figure 3:
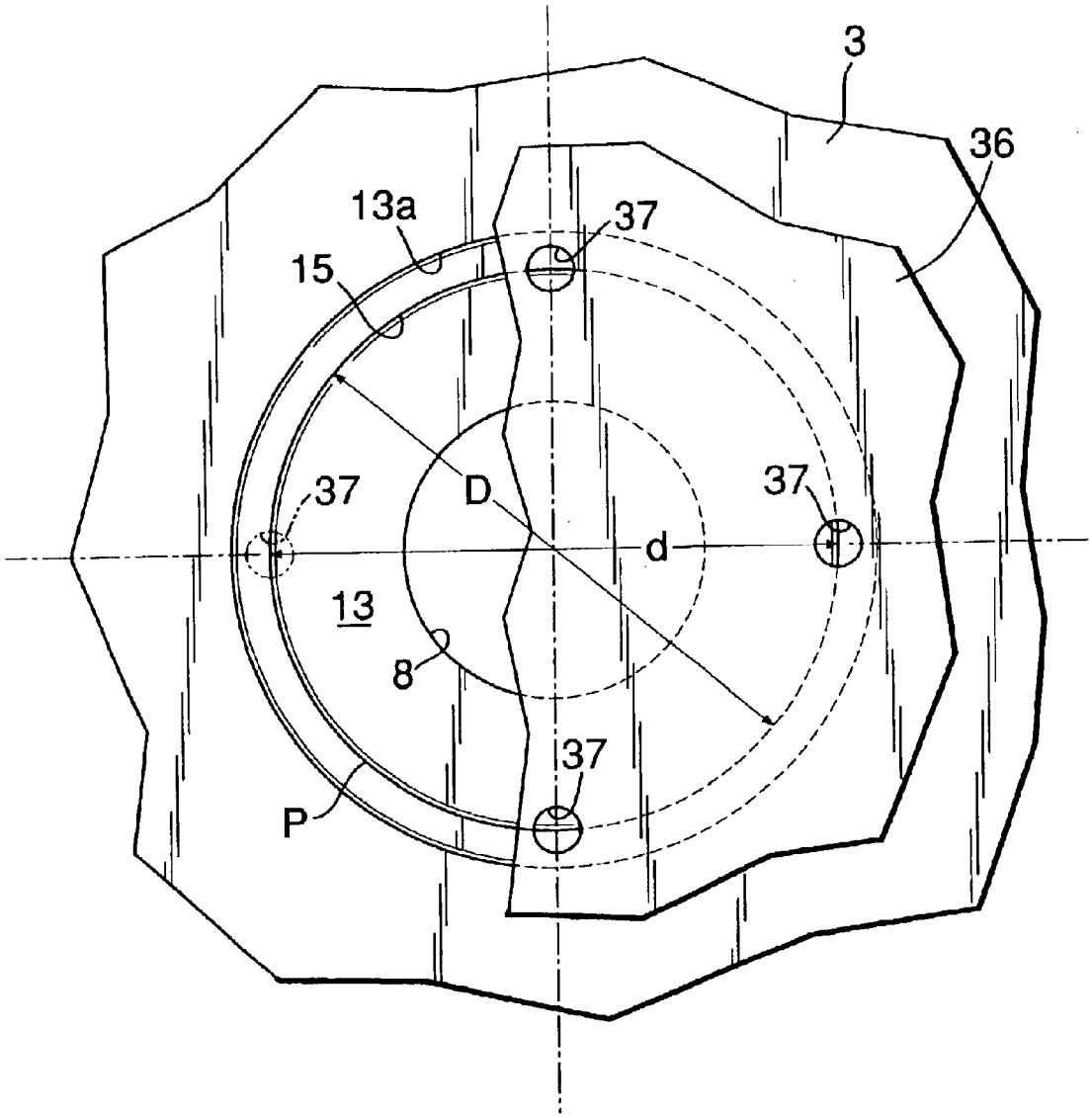
FIG. 3 is a sectional view taken along a line 3—3 in FIG. 2.
Figure 4:
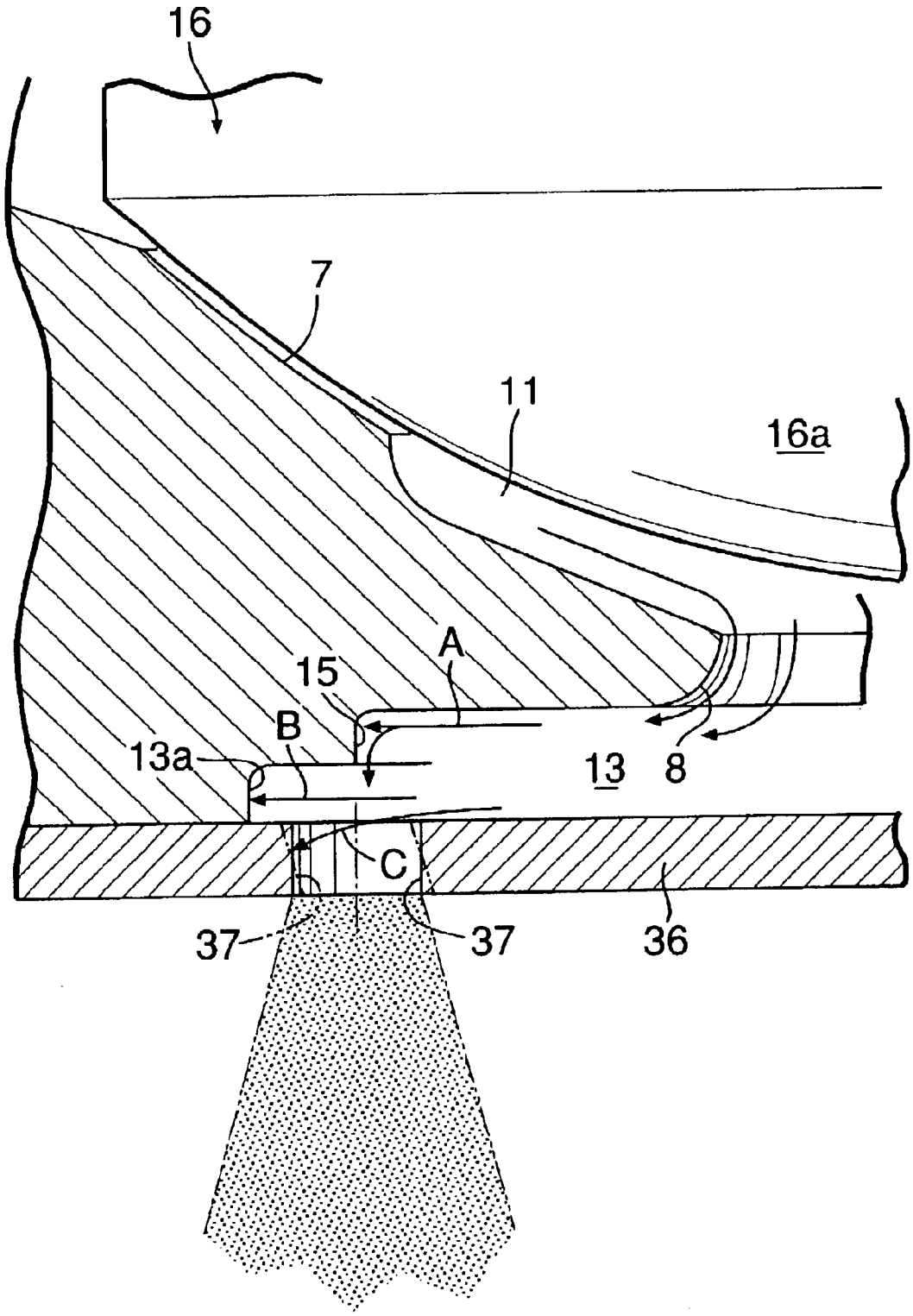
FIG. 4 is an enlarged view of essential portions of FIG. 2 for explaining the operation.

As shown in FIGS. 2 to 4, a front end wall of the valve seat member 3 is provided with a valve seat bore 8 arranged coaxially with the valve seat 7 at a location downstream from the valve seat 7, and a recess 10 which connects the valve seat bore 8 and the valve seat 7 to each other. The recess 10 defines a preliminary diffusion chamber 11 by cooperation with a tip end face of the valve portion 16*a*.

An injector plate 36 made of a steel pate is bonded to the front end face of the valve seat member 3 over the entire periphery by a laser beam welding. A plurality of fuel injection orifices 37 are provided in the injector plate 36 on a pitch circle P about an axis of the valve seat 7. A fuel diffusion chamber 13 is provided between the valve seat member 3 and the injector plate 36 to allow the valve seat bore 8 to communicate with the fuel injection orifices 37. In the illustrated embodiment, the fuel diffusion chamber 13 is defined by a flat recess 14 widening radially outwards from an outer end edge of the valve seat bore 8, and an upper surface of the injection plate 36. Each of the fuel injection orifices 37 is disposed so that its axis is parallel to an axis of the valve seat bore 8 (shown by a solid line in FIG. 4), or is nearing the axis of the valve seat bore 8 in an axially outward direction (shown by a dashed line in FIG. 4).

An annular step 15 is formed on a ceiling surface of the fuel diffusion chamber 13 so that its height is reduced gradually radially outwards, and the plurality of fuel injection orifices 37 are disposed immediately below the step 15. In this case, the pitch circle P passing through a center of each of the plurality of fuel injection orifices 37 has a diameter d set at a value equal to a diameter D of the annular step 15, whereby the center of each of the fuel injection orifices 37 is disposed substantially immediately below the annular step 15. Further, the fuel injection orifices 37 are disposed at locations spaced at a given distance apart from an inner peripheral wall 13*a* of the fuel diffusion chamber 13.

The valve seat bore 8 is formed into a funnel-shape increased in diameter toward the fuel diffusion chamber 13.

Referring again to FIG. 1, an annular seal holder 48 is fitted over the outer peripheries of the valve housing 2 and the valve seat member 3 to extend astride them. An annular groove 46 is defined between the seal holder 48 and a cap 45 made of a synthetic resin and fitted over the front end of the valve seat member 3. An O-ring 47 is mounted in the annular groove 46 to come into close contact with the outer peripheral surface of the valve seat member 3. The O-ring 47 is adapted to come into close contact with an inner peripheral surface of a fuel-injection-valve mounting bore in an intake manifold (not shown), when the solenoid-type fuel injection valve I is mounted in the mounting bore.

The operation of the first embodiment will be described below.

In a state in which the coil 30 has been deexcited, the movable core 12 and the valve member 16 are urged forwards by a biasing force of the valve spring 22, whereby the valve portion 16*a* of the valve member 16 is seated on the valve seat 7. Therefore, a high-pressure fuel supplied through the fuel filter 27 and the inlet tube 26 into the valve housing 2 is left on standby within the valve housing 2.

When the coil 30 is excited by supplying electric current thereto, a magnetic flux generated thereby runs sequentially through the stationary core 5, the coil housing 31, the valve housing 2 and the movable core 12, whereby the movable core 12 is attracted to the stationary core 5 along with the valve member 16 by a magnetic force to open the valve seat 7. Therefore, the high-pressure fuel in the valve housing 2 passes the chamfers 17 of the valve member 16 and the valve seat 7, and then passes the preliminary diffusion chamber 11 and the valve seat bore 8 into the fuel diffusion chamber 13. Finally, the fuel is injected from the plurality of the fuel injection orifices 37 into an intake port in the internal combustion engine (not shown).

As best shown in FIG. 4, the fuel transferred from the valve seat bore 8 into the flat fuel diffusion chamber 13 flows to radially spread. Thereafter, the fuel A flowing along the ceiling surface of the fuel diffusion chamber 13 collides with the annular step 15 to be scattered to the periphery, and the fuel B flowing along the bottom surface of the fuel diffusion chamber 13 collides with the inner peripheral wall 13*a* of the chamber 13 to be scattered while being bounced back from the inner peripheral wall 13*a*. The scattered fuel portions again collide with one another immediately above the plurality of fuel injection orifices 37, thereby causing a fierce turbulent flow and diffusion of the fuel. Therefore, the atomization of the fuel injected from the fuel injection orifices 37 is effectively promoted, whereby the stable spray forms of the fuel can be formed and drawn into the engine along with intake air. Thus, it is possible to provide enhancements in startability and output performance of the engine as well as a reduction in fuel consumption.

In addition, since the valve seat bore 8 is formed into the funnel-shape having a diameter increasing toward the fuel diffusion chamber 13, the flowing of the fuel from the valve seat bore 8 into the fuel diffusion chamber 13 can be smoothened, whereby a high speed of collision of the fuel with the annular step 15 can be maintained, thereby contributing to the atomization of the fuel injected from the fuel injection orifices 37 and the formation of the stable spray forms.

Further, the fuel flowing from the valve seat bore 8 along the bottom surface of the fuel diffusion chamber 13 includes a portion C immediately takes a course bent in a direction toward the fuel injection orifices 37. The fuel portion having taken the course toward the fuel injection orifices 37 collides with the inner surface of each of the fuel injection orifices 37 at a substantially right angle to thereby cause a fierce turbulent flow, because the axis of each of the fuel injection orifices 37 is parallel to the axis of the valve seat bore 8, or is inclined so that it is nearing the axis of the valve seat bore 8 in an axially outward direction. Thus, when such fuel is injected from the fuel injection orifices 37, it can be peeled off from the surface of the injector plate 36. This also contributes to the promotion of the atomization of the fuel and the formation of the stable spray forms.

Figure 5:
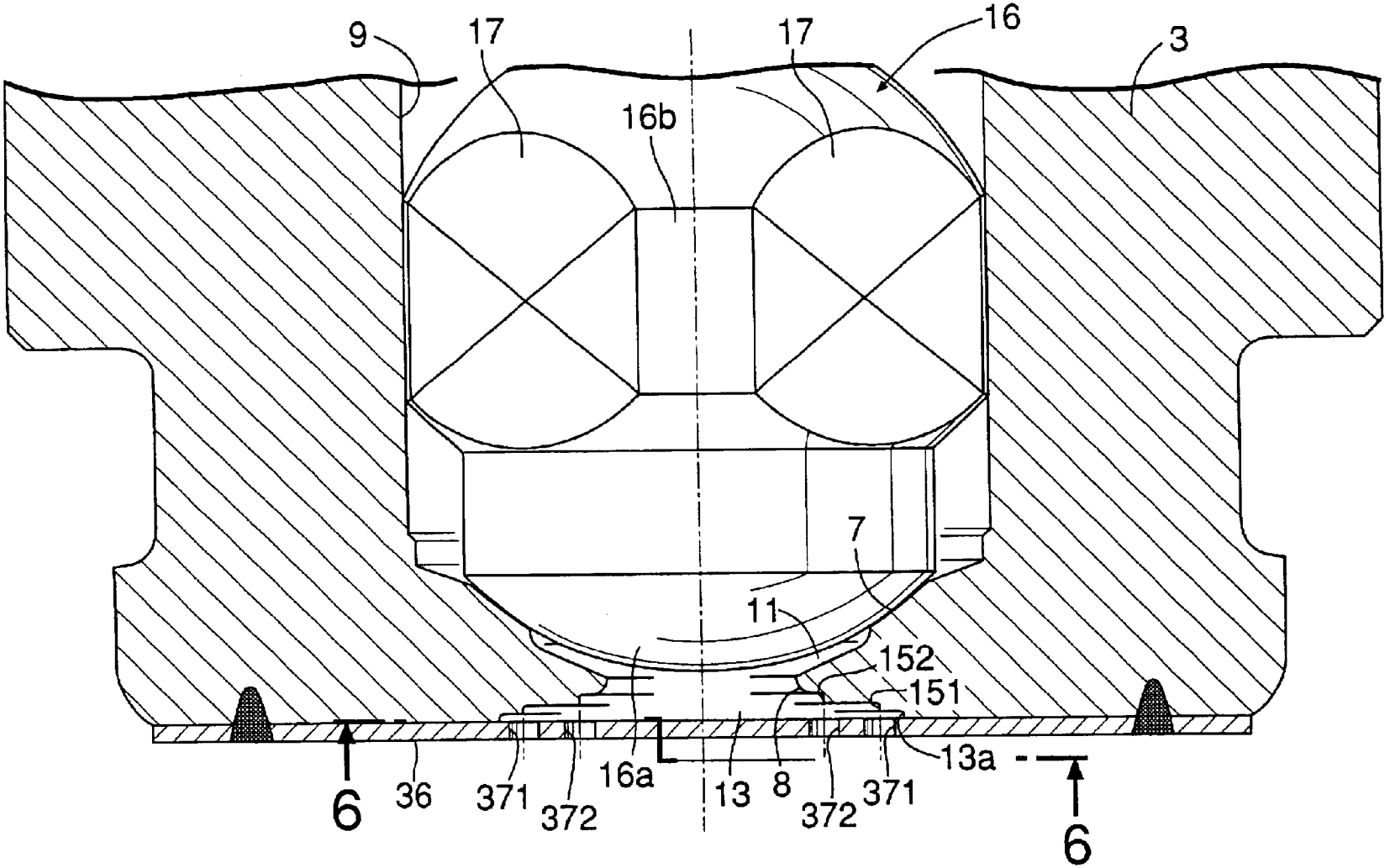
FIG. 5 is a view similar to FIG. 2, but showing a second embodiment of the present invention.
Figure 6:
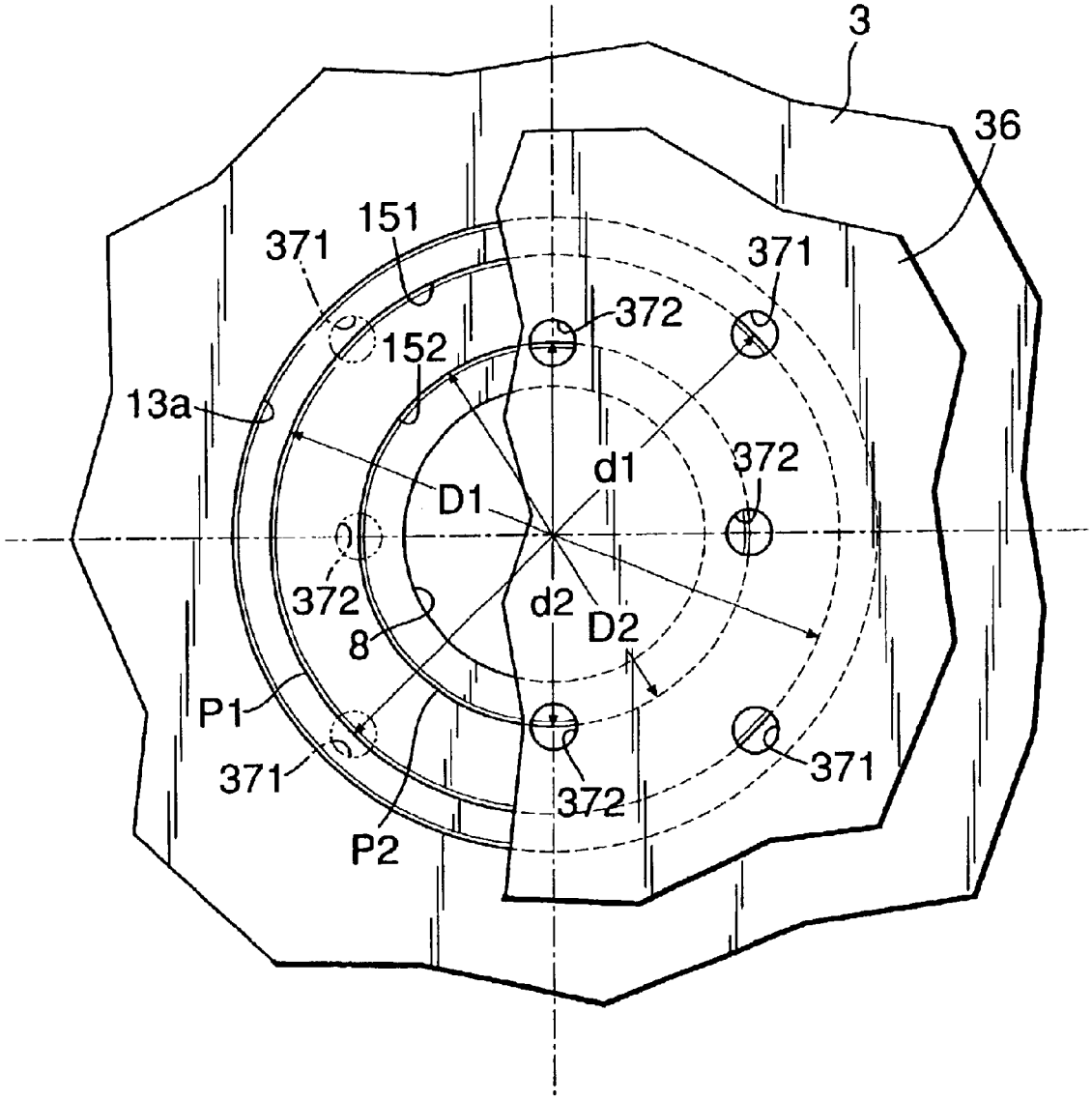
FIG. 6 is an enlarged sectional view taken along a line 6—6 in FIG. 5.

A second embodiment of the present invention will now be described with reference to FIGS. 5 and 6.

In the second embodiment, a plurality of (two in the illustrated embodiment) annular steps 151 and 152 having different diameters D1 and D2 are formed concentrically and in a stair-shape on a ceiling surface of the fuel diffusion chamber 13. A plurality of fuel injection orifices 371 is disposed immediately below the larger diameter-annular step 151 on a pitch circle P1 having a diameter d1 equal to the diameter D1 of the larger-diameter annular step 151. A plurality of fuel injection orifices 372 is disposed immediately below the smaller-diameter annular step 152 on a pitch circle P2 having a diameter d2 equal to the diameter D2 of the smaller-diameter annular step 152. The fuel injection orifices 371 and 372 are disposed with their phases displaced from each other. The arrangement of the other components is the same as that in the previous embodiment. Hence, the portions or components corresponding to those in the previous embodiment are designated by the same reference numerals and symbols in FIGS. 5 and 6 and the description of them is omitted.

In the second embodiment, the fuel transferred from the valve seat bore 8 into the fuel diffusion chamber 13 collides sequentially with the plurality of stages of the larger and smaller annular steps 151 and 152 and the inner peripheral wall of the fuel diffusion chamber 13, whereby the turbulent flow and diffusion of the fuel are further fiercely caused. Thus, it is possible to further effectively promote the atomization of the fuel injected from each of the fuel injection orifices 371 and 372 and to form further stable spray forms of the fuel.

It will be understood that the present invention is not limited to the above-described embodiments, and various modifications in design may be made without departing from the spirit and scope of the invention defined in claims.

What is claimed is:

1. A fuel injection valve comprising: a valve member; a valve seat member which has a valve seat cooperating with said valve member, and a valve seat bore leading to a downstream end of said valve seat and opening at a front end face said valve seat member; an injector plate coupled to the front end face of said valve seat member and having a plurality of fuel injection orifices; and a flat fuel diffusion chamber provided between said valve seat member and said injector plate to widen radially outwards from an outer end edge of said valve seat bore for dispensing a fuel received therein from said valve seat bore to the plurality of fuel injection orifices in a diffusing manner;

wherein an annular step is formed on a ceiling surface of said fuel diffusion chamber so that a level of the ceiling surface is gradually lowered radially outwards, and said fuel injection orifices are disposed immediately below said step and at a distance from an inner peripheral wall of said fuel diffusion chamber.

2. A fuel injection valve according to claim 1, wherein a diameter of a pitch circle of the plurality of fuel injection orifices is equal to a diameter of said annular step.

3. A fuel injection valve according to claim 1 or 2, wherein said valve seat bore is formed into a funnel-shape having a diameter increasing toward said fuel diffusion chamber.

4. A fuel injection valve according to claim 1 or 2, wherein a plurality of the annular steps having different diameters are formed in a stair-shape on the ceiling surface of said fuel diffusion chamber, and a plurality of the fuel injection orifices are disposed on each of a plurality of pitch circles having different diameters in correspondence to said annular steps, respectively.

* * * * *